United States Patent [19]

Silvern

[11] 4,313,505

[45] Feb. 2, 1982

[54] ROTARY IMPACT CLUTCH

[75] Inventor: David H. Silvern, Los Angeles, Calif.

[73] Assignee: Rodac Pneumatic Tools, Carson, Calif.

[21] Appl. No.: 70,149

[22] Filed: Aug. 27, 1979

[51] Int. Cl.[3] ..... B25D 15/02

[52] U.S. Cl. ..... 173/93.5

[58] Field of Search ..... 173/93, 93.5, 94, 97, 173/93.6, 93.7; 81/52.3, 466

[56] References Cited

U.S. PATENT DOCUMENTS

| | | | |
|---|---|---|---|
| 2,339,530 | 1/1944 | Van Sittert et al. | 173/93.5 |
| 2,684,738 | 7/1954 | Kaplan | 173/93.5 |
| 2,836,272 | 5/1958 | Kaman | 173/93.6 |
| 3,174,597 | 3/1965 | Schaedler et al. . | |
| 3,175,660 | 3/1965 | Kaman | 173/93 X |
| 3,414,065 | 12/1968 | Falter . | |
| 3,908,706 | 9/1975 | Hess | 173/93.5 X |

*Primary Examiner*—Werner H. Schroeder
*Assistant Examiner*—Andrew M. Falik
*Attorney, Agent, or Firm*—Herzig & Walsh Inc.

[57] ABSTRACT

An improved rotary impact clutch or impact wrench of the type normally used for setting threaded fasteners by imparting rotary impacts. The combination includes a hammer member which is driven; an anvil to which the rotary impacts are delivered. Pins which may be referred to as dog pins or anvil pins are carried in axial recesses on the inside of the hammer member and are movable axially against the force of a spring to come into position to deliver impacts against lobes of the anvil member. Ball cam means are provided associated with a cam sleeve which has engagement with the dog pins for the imparting of the axial movement to them. The dog pins or anvil pins are generally cylindrical, having an intermediate part of smaller diameter. The improvements reside primarily in a further component preferably in the form of a ring, shaped to be positioned inside of the hammer and having diametrically opposed recesses to engage the end parts of the dog or anvil pins. The combination with this part achieves the purpose that the anvil pins are held accurately in position while moving angularly with the hammer member and axially relative to it into a position to impact the anvil.

8 Claims, 9 Drawing Figures

10
12
14
16
17
2
2
32
34
36
38
38'
50
53
54
58
64
65
66
68
72
73
74
80
82
83
83'
92
94
96
104
108
110
116
116'
118
119
120
128
130
130'
134

ROTARY IMPACT CLUTCH

BACKGROUND OF THE INVENTION

1. Field of the Invention

The field of the invention is that of rotary impact clutches or impact wrenches, as identified hereinafter.

2. Description of the Prior Art

There are a substantial number of expired and unexpired patents directed to rotary impact clutches or wrenches. These tools are driven by a motor which typically may be an air motor. They operate typically to impart rotation onto a fastener and then to set the fastener by imparting blows or impacts to complete the tightening.

Typically the wrenches of this type in the prior art embody a combination which includes a rotatable hammer and dog means which may be carried by the hammer and which can move axially while rotating to deliver impacts or blows to an anvil. The anvil is an element usually carried on a camshaft which carries the socket or element to be rotated and impacted. Typically there is some type of cam means which may include a ball cam and which during rotation imparts the axial movement which moves the pins axially into position to impact on the anvil.

It has been known in the prior art to provide dog pins which may be carried either by the hammer for axial movement relative thereto or by the anvil. In typical prior art designs the dog pins may be carried in axial bores in the hammer member. The prior art, however, also teaches the carrying of the dog pins in axial slots or grooves that may be in the hammer or otherwise for the purpose of achieving results that are outlined in this type of prior art.

The deficiency in the prior art as described, has been that the construction with dog pins in axial bores is too complicated and cumbersome. With the dog pins in axial slots or grooves the pins would come out of the grooves rather than staying in them. This would cause the pins to hit the anvil on an edge breaking the pins. The herein invention overcomes the deficiencies of the prior art.

With respect to the prior art, U.S. Pat. No. 2,285,638 is considered typical of that type of combination wherein dog pins are carried in bores. With respect to the prior art of which the herein inventor has knowledge, it is considered that the following patents are relatively the most relevant: U.S. Pat. Nos. 3,001,428; 3,174,597; 3,414,065; and 3,428,137.

SUMMARY OF THE INVENTION

The nature of the invention has been briefly indentified in the abstract. The manner of utilization of impact clutches or wrenches of the type disclosed herein is well known in the art.

In a preferred form of the invention as described in detail hereinafter it embodies a hammer driven by a motor, which preferably may be an air motor. The hammer itself does not reciprocate. The hammer carriers dog pins or anvil pins in axial slots formed in the walls of a bore within the hammer. A shaft is provided for the threaded fastener that is to be set and this shaft carries the anvil which is impacted by the dog pins when moved axially during rotation of the hammer.

A shaft carries a cam sleeve having a cam member which cooperates with a ball carried in an axial bore or recess in the base of the hammer. An angular circumferential extension of an annular raceway in the hammer is provided. The axial movement of the cam sleeve in impacting directionally is resisted by a spring.

The dog pins are generally cylindrical, having an intermediate part of smaller diameter. The invention provides in the combination, a ring member which surrounds the cam sleeve and spring, the ring member having diametrically opposed arcuate recesses which fit against parts of the dog pins. Thus this member occupies space on the inside of the dog pins that would otherwise be unoccupied.

Important objects and results are realized by the ring member as described. In previous constructions the dog pins tended to become misaligned, coming out of the grooves in which they reside so as to not squarely and accurately impact on the anvil. The result was that the anvil would break, requiring frequent replacement. That is, the ears or lobes on the anvil would be broken or sheared off.

The primary object of the invention is to realize and achieve the purpose as set forth of avoiding the deficiency as defined with respect to dog pins carried in the slots or grooves in a rotating element rather than in bores.

A further object is to achieve the results that the pins strike the anvil more squarely with greater force.

A further object is to reduce the tendency of the pins becoming misaligned; of the anvil breaking; of not striking the anvil squarely with the desired effort.

A further object is to achieve an increase in the useful life of the anvil.

Further objects and additional advantages of the invention will become apparent from the following detailed description and annexed drawings.

DESCRIPTION OF THE PREFERRED EMBODIMENT AND BEST MODE OF PRACTICE OF THE INVENTION

Figures 1, 8, 9:
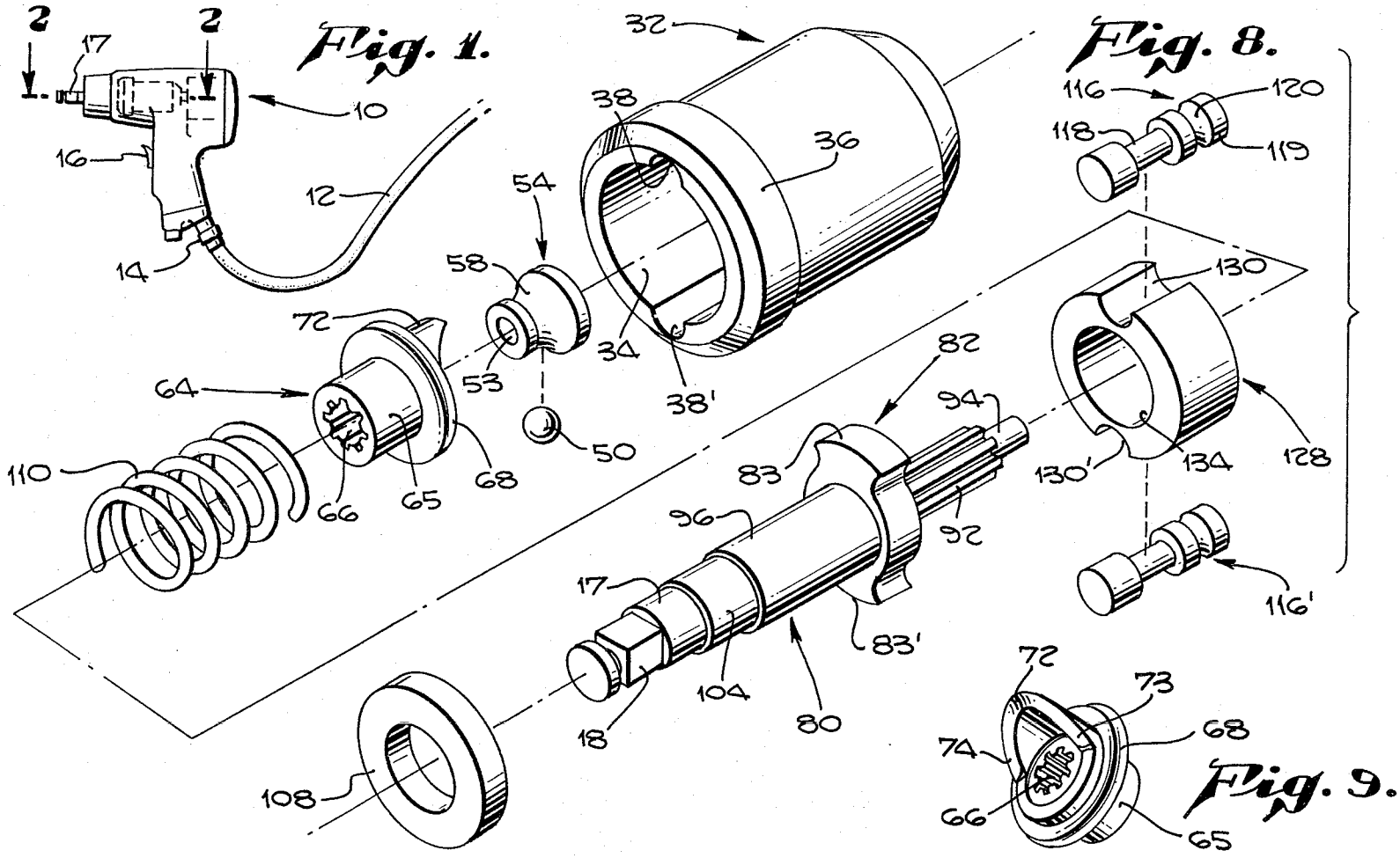
FIG. 1 is a pictorial view of a tool, that is an air driven impact wrench embodying the invention.
FIG. 8 is an isometric exploded view of the invention.
FIG. 9 is a perspective view of the cam member.

Referring to FIG. 1 of the drawings, a tool is shown at 10 which embodies the improvements of the invention. In the exemplary form, the tool is driven by an air motor being supplied with air through a hose 12 and fitting 14. The tool has a trigger 16 and an extending shaft 17 with a fitting 18, adapted for example to receive a socket or socket wrench.

Parts of the combination are shown on the exploded view, FIG. 8. This Figure shows the essential parts of the combination. All of the parts shown in FIG. 8 are aligned and when assembled are in a position as may be seen in FIGS. 2 and 5 and in the sectional views 3,4,6, and 7. The tool shown has a cylindrical body or housing as shown at 21 which has a bore 24 in which the clutch is received as will be described. The driving motor preferably may be an air motor is designated at 26, the drive motor having a splined shaft as designated at 28 and which will be referred to again presently.

Numeral 32 designates the hammer. It is cylindrical, having a bore 34 and a front end rib or enlargement 36. Within it there are two diametrically opposed axial grooves, designated at 38 and 38' which will be referred to again presently.

The base of the hammer is relatively massive and formed in the base is another bore 44 of smaller diameter than the bore 34. In the preferred form the base of this bore is radial, that is it lies in a radial plane. At one side of this bore there is an extension in the form of circumferencial groove 46 which extends for a limited number of degrees which may correspond in numbers to prior art configurations as referred to in the foregoing. Numeral 50 designates a cam ball which is trapped in the groove 46 and which will be referred to again presently.

Referring to FIG. 8, numeral 54 designates a part which is a cam pilot member. It has a bore 53 and portions 55 and 56 of different diameters with a ball race 58 in between. Normally the ball is trapped between the cam pilot 54 and the groove 46 as may be seen in FIGS. 2 and 5.

Figure 6:
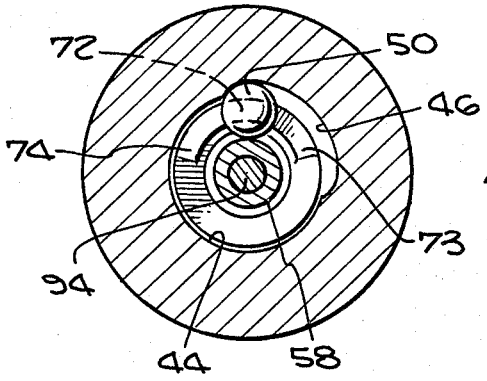
FIG. 6 is a sectional view taken along the line 6—6 of FIG. 2.
Figure 7:
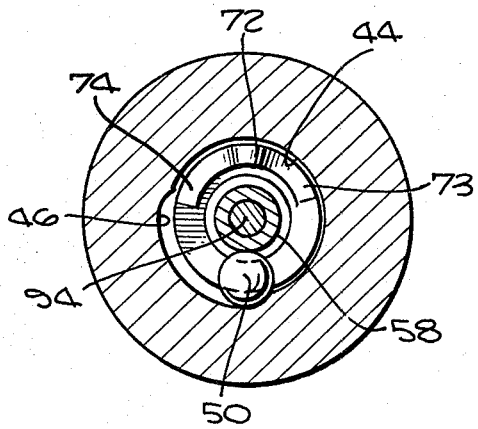
FIG. 7 is a sectional view taken along the line 7—7 of FIG. 5.

Numeral 64 designates the cam sleeve or cam member. It has cylindrical part 65 which has a splined bore 66 which will be referred to again presently. It has a larger intermediate part 68 the outer periphery of which is rounded or smooth and which engages with the anvil dogs as will be referred to again presently. The cam sleeve 64 carries an extending cam member 72 which forms an end rise with gradually rising surfaces adjacent at as designated at 73 and 74 in FIGS. 6 and 7. Normally the cam rise 72 extends into the raceway 58 of pilot member 54 as may be seen in FIGS. 2 and 5.

In FIG. 8, Numeral 80 designates the anvil shaft. It carries the anvil 82. The anvil 82 has two diametrically opposed lobes or ears 83 and 83', the opposite side each of which are arcuate as shown.

The anvil shaft 80 has a forward part which is splined, as may be seen at 92 and a pilot stem 94. The cam pilot 54 has a bore 53 to fit on to the stem 94. The splined part 92 of the shaft 80 is received in the splined bore 66 in the cam member 64. The shaft 80 has a diameter 96 to fit bushing 98 as may be seen in FIG. 2 which is received in a bore in the end part of the housing 10, the bushing having an end flange 99, which fits into a counter-bore 102 in the end part of the housing 10 as may be seen in FIG. 2. The shaft 80 has another part 104 of a smaller diameter that is received in a bore in the end part of the housing 10 as may be seen in FIG. 2. Numeral 108 designates a spacer member normally in a position between the anvil 82 and the end of the bushing 98 as may be seen in FIG. 2.

Figures 2, 3, 4:
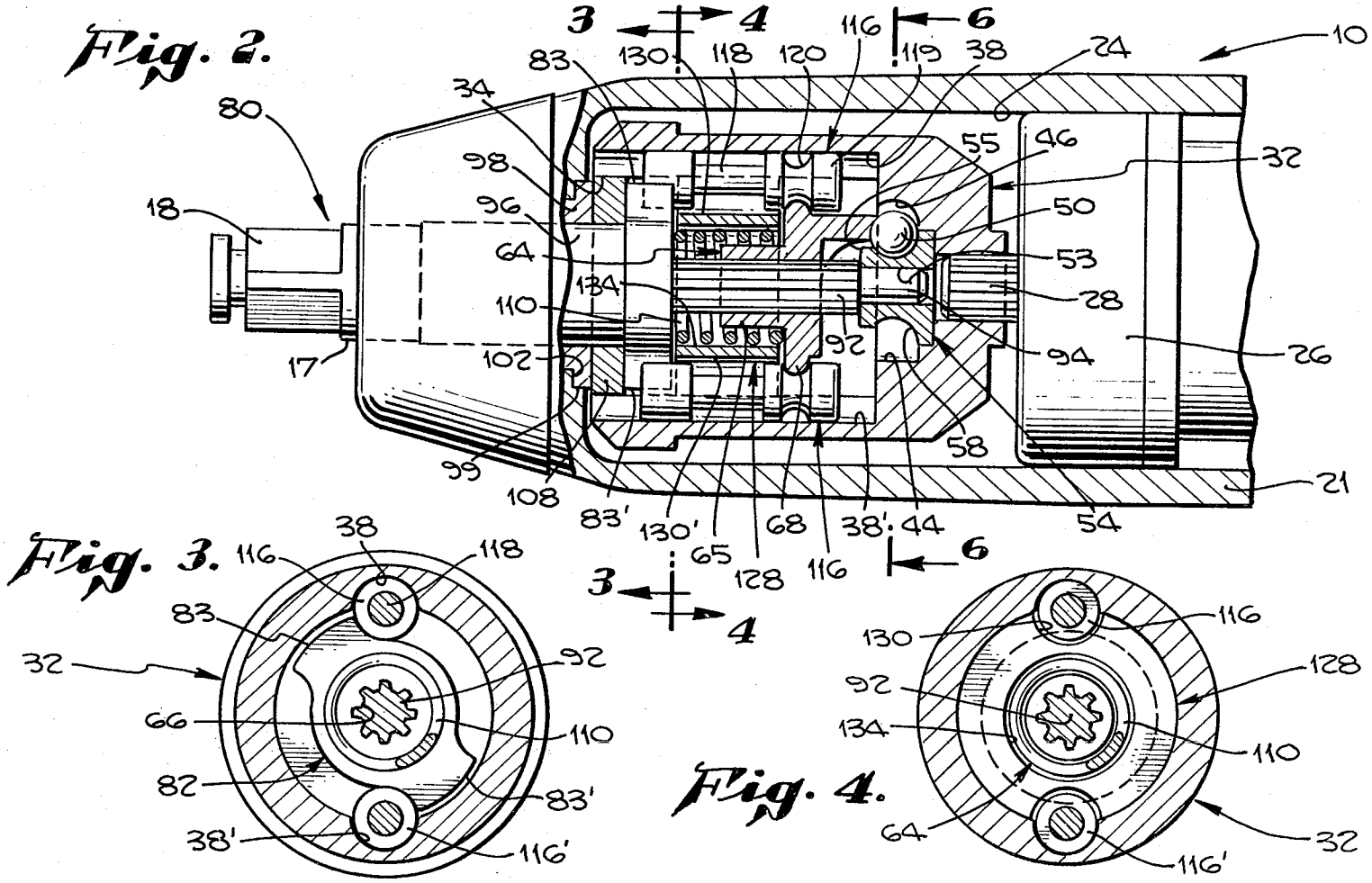
FIG. 2 is a view partly in cross-section of a preferred form of the invention.
FIG. 3 is a sectional view taken along the line 3—3 of FIG. 2.
FIG. 4 is a sectional view taken along the line 4—4 of FIG. 2.
Figure 5:
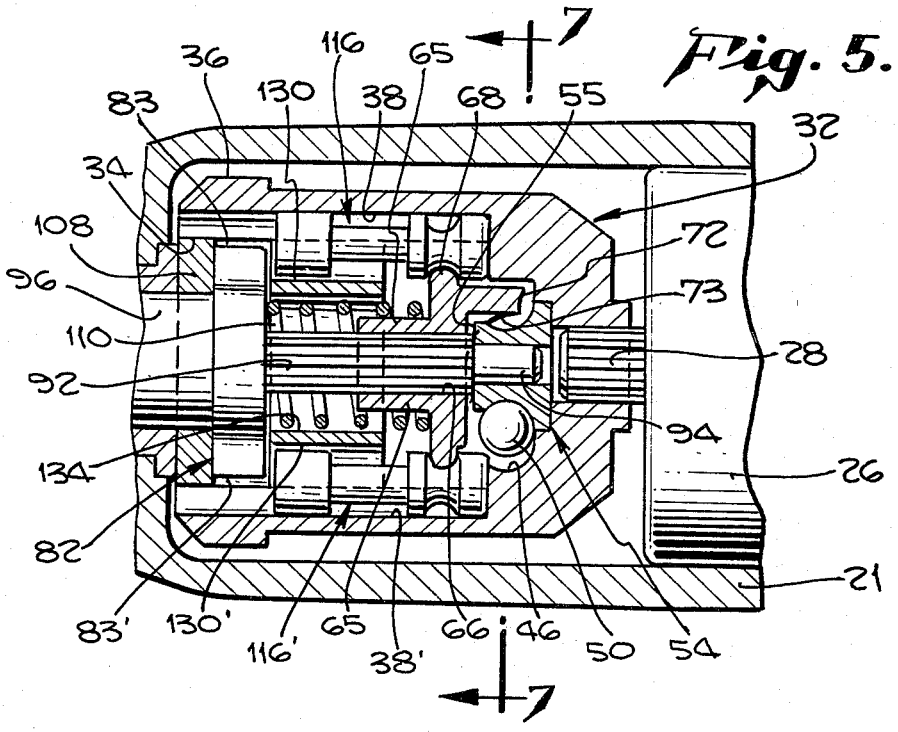
FIG. 5 is a sectional view similar to that of FIG. 2 showing the parts with the dog pins in retracted position with respect to the anvil.

Numeral 110 designates a helical coiled biasing spring of a size to fit around the shank 65 of the cam member 64 as may be seen in FIGS. 2 and 5. This biasing spring normally urges the driving cam mechanism in a direction away from the anvil as will be described in more detail presently.

The interior configuration of the hammer 32 is illustrated in FIG. 8 and also in FIGS. 2,5,6, and 7. Dog pins are received in the axial grooves 38 and 38' of the hammer 32, one of the dog pins being designated by the numeral 116 and the other which is like it by the numeral 116'. Dog pin 116 has an intermediate part 118 of smaller diameter, being smaller in diameter than the end parts. The after end part 119 of dog pin 116 has an annular groove 120 in which is received the periphery of the enlarged part 68 of the cam member, as is clearly illustrated in FIGS. 2 and 5. The part 68 is integral with the cam member as shown and it engages in the grooves 120 in the anvil dogs so that they are carried axially along with the cam 64.

A very significant aspect of the invention is the ring or holder member as designated at 128 in FIG. 8. This ring member has an axial extent which is greater than the part 118 of the anvil dogs of smaller diameter. The ring 128 has diametrically opposed axial arcuate grooves 130 and 130' which have a radius so as to fit the enlarged ends of the dog pins 116 and 116'. This relationship is illustrated in FIGS. 2 and 5. The ring 128 of course has a central bore 134 which is of a size to fit around the outside of the spring 110, as may be seen in FIGS. 2 and 5. The ring 128 is in a position to float between the spring 110 and the two dog pins. Since the axial grooves 130 and 130' engage the larger portions of the dog pins the dog pins are held in the grooves 38 and 38' of the hammer during rotation and axial movement of the dog pins. This relationship serves to accomplish the purposes that have been referred to in the foregoing, particularly that the dog pins are held in alignment and are moved accurately in the axial direction so as to have square and forceful impacts against the lobes 83 and 83' of the anvil during operation. Although the ring member 128 retains the dog pins in position as described they contribute very little additional friction to the assembly.

FIG. 2 illustrates the parts in a position when the dog pins have been moved axially so that their orbit intercepts the lobes of the anvil to impact against it. The spring 110 is compressed. FIG. 5 illustrates the position of the parts when the spring is extended, the rise or lobe 72 of the cam 64 is extended into the raceway 44. The dog pins are in retracted position such that during rotation they would not intercept the lobes of the anvil 82.

From the foregoing it is to be observed that the hammer 32 is directly driven by the driving motor 26. Also the cam member 64 is an integral part having the cam lobe 72 with raceway surfaces 73 and 74 and the holding circular part 68 which engages in the annular grooves in the dog pins for moving them axially.

OPERATION

In setting a threaded fastener the tool will first simply rotate the fastener to a tight position after which it is fully set or made tight by the application of impacts to the anvil which are transmitted to the fastening device through the shaft and through the socket at the end.

With the respect to detailed operation, the operation is similar to that of devices identified in the patents referred to in the foregoing, except as to certain features and operations as identified hereinafter particularly related to the improvements of the herein invention.

The tool can be operated in either direction, either clockwise or counter-clock-wise. FIG. 5 illustrates an inactive position in which no axial movement has been imparted to the cam member 64 and the dog pins. The cam ball 50 is normally trapped in the limited circumferencial groove 46 previously described in connection with the ball race 44 in the hammer 32 and the ball race 58 in the cam pilot 54. The angular groove 46 may extend for perhaps 80 degrees, by way of example. Its ends form shoulders which have a spherical configuration for engaging and driving the ball 50. Thus the ball is driven through the hammer 32 by reason of its engagement with the cam lobe 72. It has the capability of imparting rotation to the cam member 64 and to the shaft 80 and the anvil 82. When the shaft 80 encounters sufficient resistance the cam ball 50 can ride up one of the surfaces 73–74, depending upon the direction of rotation, and override the end surface or end of the cam lobe 72. When it overrides the cam lobe axial movement is imparted to the cam member 64 and through its driving part 68 which is engagement with the dog pins moves them in an axial direction so that their orbit intercepts the lobes or ears 83 and 83′ and impacts are delivered to the anvil. The diameter of the ends of the dog pins 116 are as such as to conform to the concavaties on the sides of the lobes 83 and 83′ of the anvil. When the dog pins move in a direction to impact they are of course moving helically, being rotated by the hammer and being moved axially by the cam member 64. The completion of the axial movement is of course substantially at the position at which the cam ball 50 overrides the cam lobe 72. After the ball overrides the cam lobe, the cam member 64 and dog pins are again moved in axial direction the other way by the biasing spring 110 back into a position at or similar to the position shown in FIG. 5.

During the movement of the dog pins as described they are held constrained to move in the axial grooves 38–38′ of the hammer 32 by the ring member 128 which has been previously described, is of a size so that the grooves 130 and 130′ can fit the enlarged portions of the dog pins 116 and 116′ which are adjacent to the intermediate portion 118 of smaller diameter. As described the ring member is in a position between the spring 110 and the dog pins as may be seen in FIGS. 2–5.

The power provided by the motor 26, the spring tension of spring 110 and the length of the cam lobe 72 are of course appropriately dimensioned and designed to effectuate the purposes of the tool as have been described in the foregoing.

From the foregoing those skilled in the art will recognize that the tool embodies improvements particularly in the holding ring 128 as described in detail. The tool is further simplified and made more effective by reason of such simplification both from the standpoint of fabrication and maintenance of the tool. The improved construction by way of the ring 128 improves the durability of the assembly and the wearability by enhancing the working life of the anvils.

From the foregoing and those skilled in the art will readily understand the nature and construction of the invention and the improvements and the manner in which the objects as set forth in the foregoing are realized.

With respect to the improvement which has been delineated in the foregoing a preferred form of the improvement and mode of practicing the invention have been illustrated in detail herein. The invention, however, shall be understood to embrace equivalent constructions within proper range of equivalency which have the capability of producing similar results.

The foregoing disclosure is representative of a preferred form of the invention and is to be interpreted in an illustrative rather than a limiting sense the invention to be accorded the full scope of the claims appended hereto.

I claim:

1. In an impact clutch of the type embodying parts including a hammer and an anvil, both of which are rotatable about an axis, cylindrical dog pins constructed to have sliding movement with respect to the hammer so that the dog pins come into position to impact against the anvil, cam mechanism having means engageable with the dog pins for imparting the axial movement to the dog pins into the path of rotation of the anvil, the improvement comprising the hammer having arcuate axial grooves in a wall thereof which are open at only one side in which the dog pins are mounted for sliding axial movement and a circular member spaced from said wall separate from said means spaced from said wall and positioned with respect to the dog pins and the member having axial grooves so as to constrain the dog pins to be held in the grooves.

2. A clutch as in claim 1 wherein the grooves include at least one arcuate cut-out in the circular member having a diameter to engage a circular part of a dog pin.

3. A clutch as in claim 2 wherein the grooves include diametrically opposed arcuate cut-outs for engaging the dog pins.

4. A clutch as in claim 1 wherein the dog means includes at least one cylindrical dog having an intermediate portion of smaller diameter than its end parts, the said circular member having an axial extent exceeding that of the said portion of smaller diameter.

5. In an impact clutch of the type embodying parts including a hammer and an anvil, both of which are rotatable about an axis, cylindrical dog pins carried by one of the parts in rotation and constructed to have sliding movement with respect to the hammer so that dog pins can come into position to impact against the anvil, cam mechanism for imparting the axial movement to the dog pins into the path of rotation of the anvil, the improvement comprising one of the rotatable parts having axial grooves in a wall thereof which are open at only one side in which the dog pins are mounted for sliding axial movement and a circular member engageable with said dog pins and positioned with respect to the dog pins and the member having axial grooves so as to constrain the dog pins to be held in the grooves, cam mechanism including a recess in the hammer, the said recess having a circumferential groove, a cam sleeve having a cam rise, a cam ball normally engaged in a raceway formed at least in part by said recess to be engageable by the cam rise, the said cam sleeve being an integral part having a portion configurated to engage the said dog pins for driving the dog pins.

6. In an impact clutch of the type embodying parts including a hammer and an anvil both of which are rotatable about an axis, cylindrical dog pins carried by one of the parts during rotation and constructed to have sliding movement with respect to the hammer so that the dog pins can come into position to impact against the anvil, cam mechanism for imparting the axial movement to the dog pins into the path of rotation of the anvil, the improvement comprising one of the rotatable parts having axial grooves in which the dog pins are mounted for sliding axial movement and a circular member positioned with respect to the dog pins and the member having axial grooves so as to constrain the dog pins to be held in the grooves the circular member having opening means configurated to engage the dog pins for holding them, the dog pins including at least one cylindrical dog having an intermediate portion of smaller diameter, the said circular member having an axial extent exceeding that of said portion of smaller diameter, the said circular member having a floating relationship to the dog pins.

7. A clutch as in claim 6 including a bias spring normally urging the dog pins in a direction away from the anvil, the said circular member being between the said spring and the dog pins.

8. In an impact clutch of the type embodying parts including a hammer and an anvil, both of which are rotatable about an axis, dog pins carried by one of the parts during rotation and constructed to have sliding movement with respect to the hammer so that the dog pins can come into position to impact against the anvil, cam mechanism for imparting the axial movement to the dog pins into the path of rotation of the anvil, the improvement comprising one of the rotatable parts having axial grooves in which the dog pins are mounted for sliding axial movement and a circular member positioned with respect to the dog pins and the member having axial grooves so as to constrain the dog pins to be held in the grooves, the cam mechanism including a recess in the hammer, the said recess having a circumferential groove, a cam sleeve having a cam rise, a cam ball normally engaged in a raceway formed at least in part by said recess to be engageable by a cam rise, the said cam sleeve being an integral part having a portion configurated to engage the said dog pins for driving the dog pins, the dog pins including at least one dog pin having an annular groove, said cam sleeve portion being circular and having a peripheral portion engageable in the annular groove in the dog pin.

* * * * *